US011074865B2

(12) United States Patent
Lee et al.

(10) Patent No.: US 11,074,865 B2
(45) Date of Patent: Jul. 27, 2021

(54) PIXEL SENSING DEVICE AND METHOD OF ORGANIC LIGHT EMITTING DISPLAY DEVICE

(71) Applicant: LG Display Co., Ltd., Seoul (KR)

(72) Inventors: Sanghoon Lee, Paju-si (KR); Hyunwook Kim, Paju-si (KR); Sangyun Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/688,488

(22) Filed: Nov. 19, 2019

(65) Prior Publication Data

US 2020/0175925 A1 Jun. 4, 2020

(30) Foreign Application Priority Data

Dec. 3, 2018 (KR) ..... 10-2018-0153701

(51) Int. Cl.
*G09G 3/3258* (2016.01)

(52) U.S. Cl.
CPC ... *G09G 3/3258* (2013.01); *G09G 2300/0439* (2013.01); *G09G 2310/0251* (2013.01); *G09G 2320/0233* (2013.01)

(58) Field of Classification Search
CPC ..... G09G 3/3258; G09G 3/3233; G09G 2320/0233; G09G 2320/0223; G09G 2320/45; G09G 2320/0295; G09G 2320/043; G09G 2310/0251; G09G 2300/0439; G09G 2300/0452
See application file for complete search history.

(56) References Cited

U.S. PATENT DOCUMENTS

2014/0184481 A1* 7/2014 Kim ..... G09G 3/3233 345/82
2016/0012798 A1* 1/2016 Oh ..... G09G 3/325 345/205

FOREIGN PATENT DOCUMENTS

KR 10-2017-0021406 A 2/2017

OTHER PUBLICATIONS

The Intellectual Property Office of the United Kingdom, Office Action, GB Patent Application No. 1917417.6, dated May 26, 2020, four pages.

* cited by examiner

*Primary Examiner* — Vijay Shankar
*Assistant Examiner* — Kebede T Teshome
(74) *Attorney, Agent, or Firm* — Fenwick & West LLP

(57) ABSTRACT

The present disclosure relates to a display device and sensing method. A display device includes a plurality of pixels. At least one of the pixels includes an organic light emtting diode (OLED) and a driving transistor. The driving transistor is connected in series with the OLED with a node between the OLED and the driving transistor. During a programming period the driving transistor is turned off and the OLED is turned on. During a discharging period the driving transistor is turned off and a voltage charged on the node during the programming period is discharged through the OLED. During a sensing period the OLED is turned off and the driving transistor is turned on to generate a pixel current to be sensed.

20 Claims, 10 Drawing Sheets

Vgs1 > Vgs2

Ipix1 > Ipix2

Vsen1 < Vsen2

PIXEL SENSING DEVICE AND METHOD OF ORGANIC LIGHT EMITTING DISPLAY DEVICE

CROSS-REFERENCE TO RELATED APPLICATION

This application claims the benefit of Korean Patent Application No. 10-2018-0153701 filed on Dec. 3, 2018, which is incorporated herein by reference for all purposes as if fully set forth herein.

BACKGROUND

Field of the Technology

The present disclosure is related to an organic light emitting display device, and more particularly a pixel sensing device and a pixel sensing method in the organic light emitting display device.

Discussion of the Related Art

An active matrix type organic light emitting display device includes an organic light emitting diode OLED which emits light by itself, and has many advantages such as a high response speed, a high luminance efficiency, a high brightness and a wide viewing angle.

The organic light emitting display device arranges pixels each including the OLED in a matrix form and adjusts luminance of the pixels according to gradation of image data. Each pixel includes a driving thin film transistor TFT controlling a pixel current flowing through the OLED according to a voltage between a gate electrode and a source electrode of the driving TFT (hereinafter referred as a gate-source voltage), and controls luminance of image by an amount of light which the OLED emits proportionally to the pixel current.

An operating point voltage of the OLED (e.g., turn-on voltage of the OLED, threshold voltage of the OLED) may be changed by a process variation. Also, the OLED has deterioration characteristics in which the operating point voltage is shifted and the luminance efficiency is decreased as emission time passes. The operating point voltage of the OLED may be different for each pixel depending on process or deterioration characteristics. If OLED driving characteristics are different from pixel to pixel, an image sticking phenomenon may occur due to luminance deviations.

SUMMARY

In order to compensate for the image quality degradation due to the luminance variations, a compensation technique for sensing the OLED driving characteristics and modulating digital image data based on the sensed value is known. A conventional compensation technique senses the OLED driving characteristics by using the property that a parasitic capacitance of the OLED changes according to the process or deterioration characteristics. That is, the conventional compensation technique senses an amount of charge accumulated in the parasitic capacitor of the OLED, and determines the OLED driving characteristics based on the sensed amount of the charge.

In order to apply the conventional compensation technique to a product, differences of the OLED parasitic capacitances according to the process variation or deterioration deviation must be large enough to be sensed. However, in case of forming the OLED in a soluble process, the differences of the OLED parasitic capacitances according to the process variation or deterioration deviation may be too small to be sensed accurately.

Accordingly, the present disclosure provides pixel sensing device and method in the organic light emitting display device capable of accurately sensing the driving characteristics of the OLED.

In accordance with one aspect of the present disclosure, a display device is provided that includes a plurality of pixels. At least one of the pixels includes an OLED and a driving transistor. The driving transistor is connected in series with the OLED with a node between the OLED and the driving transistor. During a programming period: the driving transistor is turned off, and the OLED is turned on. During a discharging period: the driving transistor is turned off and a voltage charged on the node during the programming period is discharged through the OLED. During a sensing period: the OLED is turned off, and the driving transistor is turned on to generate a pixel current to be sensed.

The at least one of the pixels can include a storage capacitor connected between the node and a gate of the driving transistor. During the programming period: a reference voltage may be applied to an end of the storage capacitor connected to the node, and a data voltage to turn off the driving transistor may be supplied to an end of the storage capacitor connected to the gate of the driving transistor. During the discharging period: a data voltage to turn off the driving transistor may be supplied to the end of the storage capacitor connected to the gate of the driving transistor. The pixel current to be sensed may be based on a remaining voltage left on the node after the voltage charged on the node during the programming period is discharged through the OLED.

During the programming period a reference voltage may be applied to the node, the reference voltage being higher than an operating point voltage of the OLED. During the programming period and the discharging period: a first voltage may be applied to a cathode electrode of the OLED, the first voltage being lower than the reference voltage. During the sensing period: a second voltage may be applied to a cathode electrode of the OLED, the second voltage being higher than an operating point voltage of the OLED.

During the programming period and the discharging period: a data voltage may be applied to a gate of the driving transistor at a first level to turn off the driving transistor. During the sensing period: the data voltage may be applied to the gate of the driving transistor at a second level to turn on the driving transistor.

During the programming period: a reset switch may be turned on to allow a reference voltage to be supplied to the node. During the discharging period and the sensing period: the reset switch may be turned off.

The display device may include a current integrator connected to the node. During the sensing period the current integrator may generate a sensing output voltage by integrating the pixel current. Corrected image data may be generated based on the sensing output voltage. Responsive to an increase in the sensing output voltage, a data voltage corresponding to the corrected image data may be increased.

In accordance with one aspect of the present disclosure, in a display device including a plurality of pixels, at least one of the pixels comprising an OLED and a driving transistor connected in series with the OLED with a node between the OLED and the driving transistor, a method includes: during a programming period: turning off the driving transistor and turning on the OLED; during a discharging period: turning off the driving transistor, and discharging a voltage charged on the node during the programming period through the OLED, and during a sensing period: turning off the OLED, and turning on the driving transistor to generate a pixel current to be sensed.

The method may include, during the programming period, applying a reference voltage to the node, the reference voltage being higher than an operating point voltage of the OLED. The method may include, during the programming period and the discharging period: applying a first voltage to a cathode electrode of the OLED, the first voltage being lower than the reference voltage. The method may include during the sensing period: applying a second voltage to a cathode electrode of the OLED, the second voltage being higher than an operating point voltage of the OLED.

The method may include, during the programming period and the discharging period: applying a data voltage to a gate of the driving transistor at a first level to turn off the driving transistor, and during the sensing period: applying the data voltage to the gate of the driving transistor at a second level to turn on the driving transistor.

The method may include, during the programming period: turning on a reset switch to allow a reference voltage to be supplied to the node, and during the discharging period and the sensing period: turning off the reset switch.

The method may include, during the sensing period: generating a sensing output voltage by a current integrator connected to the node by integrating the pixel current, and generating corrected image data based on the sensing output voltage. Responsive to an increase in the sensing output voltage, a data voltage corresponding to the corrected image data may be increased.

In accordance with another aspect of the present disclosure, a display panel includes a plurality of pixels. At least one of the pixels includes a light emitting device and a driving transistor. For example, the light emitting device may be an OLED, a semiconductor light emitting diode, a quantum dot light emitting diode, etc. The driving transistor is connected in series with the light emitting device with a gate of the driving transistor connected to a first node and with a second node between the light emitting device and the driving transistor. During a programming period: the driving transistor is turned off, and the light emitting device is turned on. During a discharging period: the driving transistor is turned off and a voltage charged on the second node during the programming period is discharged through the light emitting device. During a sensing period: the light emitting device is turned off, and the driving transistor is turned on to generate a pixel current to be sensed.

During the programming period a reference voltage may be applied to the second node, the reference voltage being higher than an operating point voltage of the light emitting device. During the programming period and the discharging period: a first voltage may be applied to a cathode electrode of the light emitting device, the first voltage being lower than the reference voltage. During the sensing period: a second voltage may be applied to the cathode electrode of the light emitting device, the second voltage being higher than an operating point voltage of the light emitting device.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION OF THE ILLUSTRATED EMBODIMENTS

Figure 1:
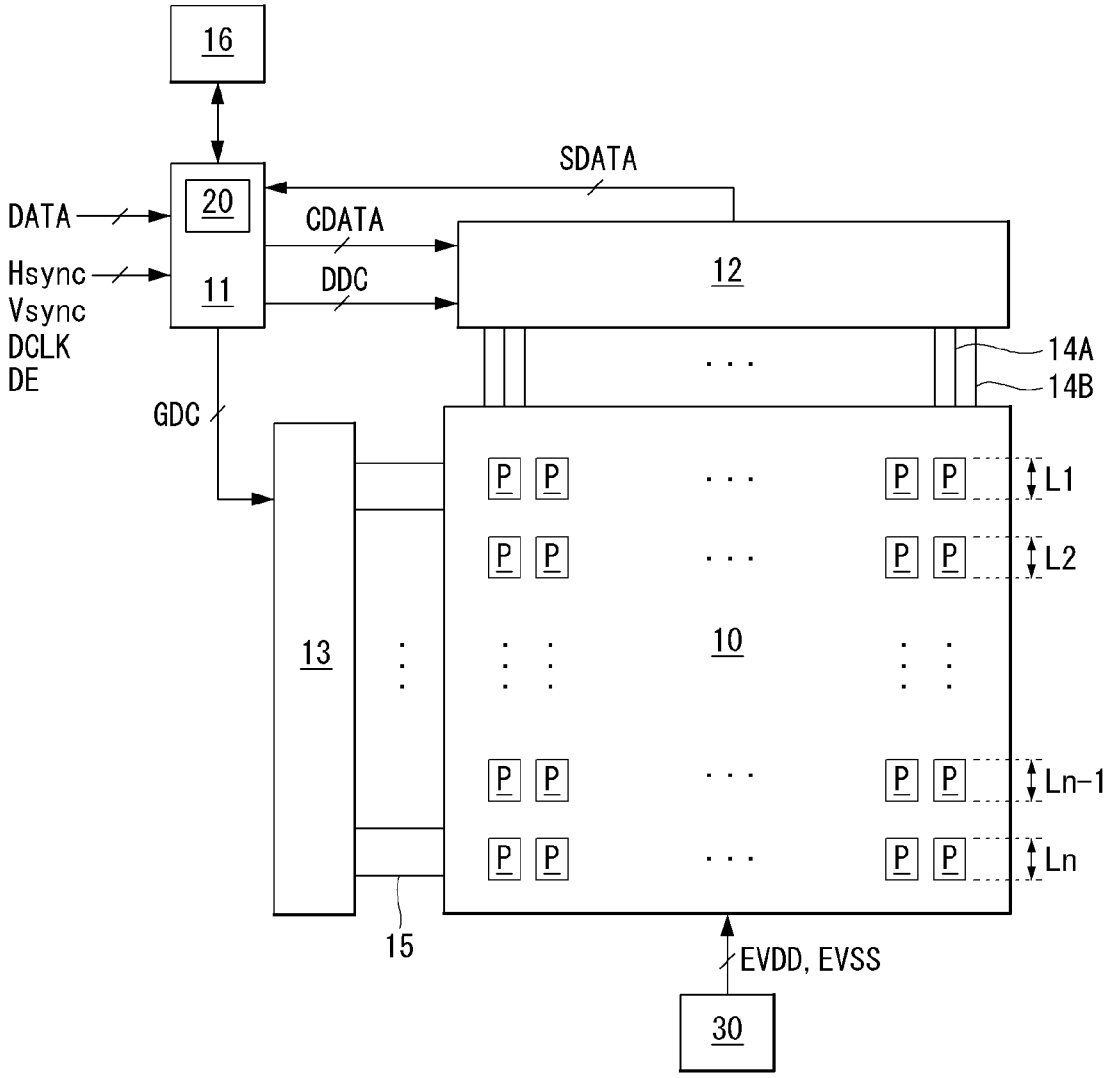
FIG. 1 shows a block diagram of an organic light emitting display device according to the present disclosure.

The advantages and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, percentages, angles, numbers, etc. shown in the figures to describe the exemplary embodiments of the present disclosure are merely examples and not limited to those shown in the figures. Like reference numerals denote like elements throughout the specification. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

It will be understood that, although the terms first, second, etc., may be used to describe various elements, these elements should not be limited by these terms. These terms are only used to distinguish one element from another element. Thus, a first element referred to below may be a second element within the scope of the present disclosure.

In this specification, the pixel circuit and the gate driver formed on the substrate of a display panel may be implemented by a TFT of an n-type metal-oxide-semiconductor field-effect transistor MOSFET structure, but the present disclosure is not limited thereto so the pixel circuit and the gate driver may be implemented by a TFT of a p-type MOSFET structure. The TFT or the transistor is the element of 3 electrodes including a gate, a source and a drain. The source is an electrode for supplying a carrier to the transistor. Within the TFT the carrier begins to flow from the source. The drain is an electrode from which the carrier exits the TFT. That is, the carriers in the MOSFET flow from the source to the drain. In the case of the n-type MOSFET NMOS, since the carrier is an electron, the source voltage has a voltage lower than the drain voltage so that electrons can flow from the source to the drain. In the n-type MOSFET, a current direction is from the drain to the source because electrons flow from the source to the drain. On the other hand, in the case of the p-type MOSFET PMOS, since the carrier is a hole, the source voltage has a voltage higher than the drain voltage so that holes can flow from the source to the drain. In the p-type MOSFET, a current direction is from the source to the drain because holes flow from the source to the drain. It should be noted that the source and drain of the MOSFET are not fixed. For example, the source and drain of the MOSFET may vary depending on the applied voltage. Therefore, in the description of the present disclosure, one of the source and the drain is referred to as a first electrode, and the other one of the source and the drain is referred to as a second electrode.

In this specification, the semiconductor layer of the TFT may be implemented by at least one of an oxide element, an amorphous silicon element, and a polysilicon element.

Hereinafter, various embodiments of the present disclosure will be described in detail with reference to the accompanying drawings. In describing the present disclosure, detailed descriptions of well-known functions or configurations related to the present disclosure will be omitted to avoid unnecessary obscuring the present disclosure.

Figure 2:
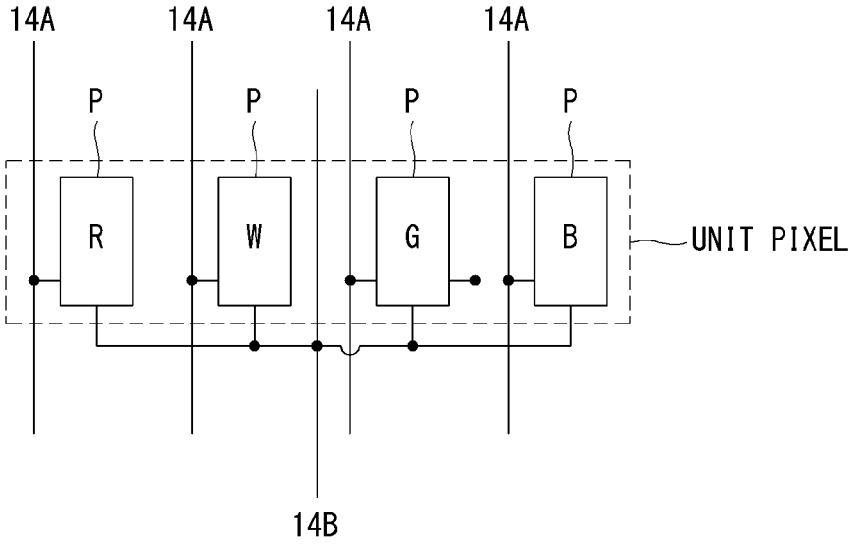
FIG. 2 shows an example of connection of a sensing line and a pixel.
Figure 3:
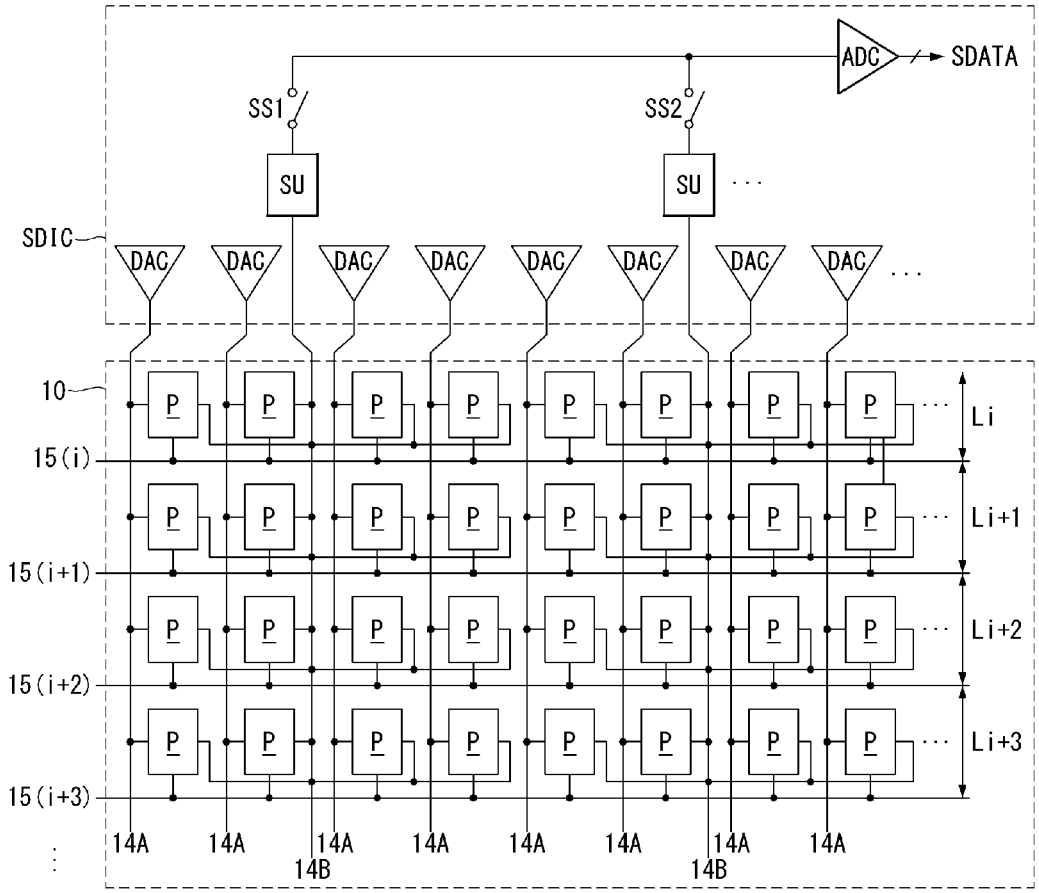
FIG. 3 shows a configuration of a pixel array and a data drive integrated circuit IC.

FIG. 1 shows a block diagram of an organic light emitting display device according to the present disclosure, FIG. 2 shows an example of connection of a sensing line and a pixel, and FIG. 3 shows a configuration of a pixel array and a data drive IC.

Referring to FIGS. 1 to 3, an organic light emitting display device according to an embodiment of the present disclosure is equipped with a display panel 10, a timing controller 11, a pixel sensing device, memory 16, and a compensation unit 20. The pixel sensing device of the present disclosure includes a pixel driving unit and a sensing unit SU. And, the pixel driving unit includes a data driving unit 12, a gate driving unit 13 and a power generator 30.

A plurality of data lines 14A and a plurality of sensing lines 14B and a plurality of gate lines 15 cross each other on the display panel 10, and pixels P are arranged in a matrix form for respective crossing regions.

Two or more pixels P connected to different data lines 14A may share a same sensing line 14B and a same gate line 15. For example, as shown in FIG. 2, a R pixel for displaying red color, a W pixel for displaying white color, a G pixel for displaying green color and a B pixel for displaying blue color, which are adjacent in a horizontal direction and connected to a same gate line 15, may be commonly connected to one sensing line 14B. A sensing line sharing structure in which one sensing line 14 is assigned to several pixel columns facilitates ensuring an aperture ratio of the display panel. In the sensing line sharing structure, one sensing line 14B may be arranged for a plurality of data lines 14A. In FIG. 2, the sensing line 14B is shown to be in parallel with the data line 14A, but may be arranged to cross the data line 14A.

The R pixel, the W pixel, the G pixel, and the B pixel may constitute one unit pixel as shown in FIG. 2. But, the unit pixel may be constituted by the R pixel, the G pixel, and the B pixel Each pixel P is supplied with a high potential pixel voltage EVDD and a low potential pixel voltage EVSS from the power generator 30. The pixel P of the present disclosure may have a circuit structure suitable for sensing the deterioration of a light-emitting element due to environmental conditions such as an elapsed driving time and/or a panel temperature. The configuration of the pixel circuit may be variously modified. For instance, the pixel P may include a plurality of switch elements, one or more storage capacitors besides a light-emitting element and a driving element.

The timing controller 11 may implement sense driving and display driving according to a predetermined control sequence. Here, the sense driving senses a driving point voltage of the light-emitting element and updates a compensation value in accordance with the sensing result, and the display driving writes corrected image data CDATA reflecting on the compensation value to represent image. Under the control of the timing controller 11, the sense driving may be performed in a booting period before the display driving starts or in a power-off period after the completion of the display driving. The booting period means a period from when a system is powered up until a screen is turned on. The power-off period refers to a period from when the screen is turned off to when the system is powered off.

Meanwhile, the sense driving may be performed in a state that the screen of the display device is turned off while system power is being applied, such as in a stand-by mode, a sleep mode, a low-power mode, and the like. The timing controller 11 may detect the stand-by mode, the sleep mode, the low-power mode, etc. according to a predetermined detecting process, and control all operations for the sense driving.

The timing controller 11 may receive, from a host system, timing signals, such as a vertical synchronization signal Vsync, a horizontal synchronization signal Hsync, a dot clock signal DCLK, and a data enable signal DE and generate data timing control signals DDC for controlling the operation timings of the data driving circuit 12 and gate timing control signals GDC for controlling the operation timings of the gate driving circuit 13, based on the timing signals. The timing controller 11 may differently generate the timing control signals DDC and GDC for the display driving and the timing control signals DDC and GDC for the sense driving.

The gate timing control signals GDC includes a gate start pulse, a gate shift clock, and the like. The gate start pulse is applied to a gate stage which generates a first output to control the gate stage. The gate shift clock is commonly input to respective gate stages and shifts the gate start pulse.

The data timing control signals DDC includes a source start pulse, a source sampling clock, and a source output enable signal. The source start pulse controls a data sampling start timing of the data driving unit 12. The source sampling clock controls data sampling timings based on a rising edge or a falling edge. The source output enable signal controls output timings of the data driving unit 12.

The timing controller 11 may include the compensation unit 20.

The compensation unit 20 receives sensing result data SDATA for the driving point voltage of the light-emitting element from the sensing unit SU in the sense driving. The compensation unit 20 calculates, based on the sensing result data SDATA, the compensation value capable of compensating for the luminance deviation according to process variations of deterioration deviation (that is, shift of the driving point voltage) of the light-emitting elements, and stores the compensation value in the memory 16. The compensation value stored in the memory 16 may be updated whenever the sensing operation is repeated, so the luminance deviation due to the characteristics differences of the light-emitting elements may be easily compensated.

The compensation unit 20 corrects input image data DATA based on the compensation value read from the memory 16 and supplies the corrected image data CDATA to the data driving unit 12, in the display driving.

The data driving unit 12 includes at least one data drive integrated circuit SDIC. The data drive IC SDIC is embedded with a digital-to-analog converter DAC connected to each data line 14A.

The DAC converts the corrected image data CDATA to a data voltage for displaying to supply it to the data lines 14A according to the data timing control signals DDC applied from the timing controller 11 in the display driving. Also, the DAC in the data drive IC SDIC may generate a data voltage for sensing to supply it to the data lines 14A according to the data timing control signal DDC in the sense driving.

The data voltage for sensing includes a first data voltage for sensing (hereinafter referred to as a data voltage for on-driving) capable of turning on the driving element, and a second data voltage for sensing (hereinafter referred to as a data voltage for off-driving) capable of turning off the driving element. The data voltage for on-driving is a voltage which is supplied to a gate electrode of the driving element to turn on the driving element in the sense driving (that is a voltage causing a pixel current to flow), and the data voltage for off-driving is a voltage which is supplied to the gate electrode of the driving element to turn off the driving element in the sense driving (that is a voltage blocking the pixel current). The data voltage for on-driving may be set to be a different value in units of R pixels, G pixels, B pixels and W pixels in consideration that the driving characteristics of the driving element/the light-emitting element are different for respective colors.

The data voltage for on-driving is applied to a sensing pixel to be sensed in one unit pixel, and the data voltage for off-driving is applied to non-sensing pixels sharing the sensing line 14B with the sensing pixel to be sensed in one unit pixel. For example, in FIG. 2, in case that R pixel is sensed and W, G and B pixels are non-sensed, the data voltage for on-driving may be applied to the driving element of the R pixel, and the data voltage for off-driving may be applied to the driving elements of the W, G, and B pixels.

Meanwhile, the sensing pixel is supplied with data voltage for off-driving as well as data voltage for on-driving. The data voltage for on-driving may be supplied during a pixel current is being sensed in the sensing pixel, and the data voltage for off-driving may be supplied during a period in which a source voltage of the driving element is set to correspond to the driving point voltage of the light emitting element in the sensing pixel.

A plurality of the sensing units SU may be mounted on the data drive IC SDIC.

Each sensing unit SU is connected to the sensing line 14B, and may be selectively connected to an analog-to-digital converter ADC through mux-switches SS1-SSk. Each sensing unit SU may be implemented as a current integrator or a current-voltage converter such as the current integrator. Since each sensing unit SU is implemented as a current sensing type, it is adequate for low current sensing and high speed sensing. That is, if configuring each sensing unit as the current sensing type, it is advantageous to reduce sensing time and increase sensing sensitivity. The ADC may convert a sensing output voltage output from each sensing unit SU into the sensing result data SDATA to output it to the compensation unit 20.

The gate driving unit 13 may generate gate signals for sensing based on the gate control signals GDC and sequentially supply them to the gate lines 15 in the sense driving. The gate signals for sensing are scan signals for sensing synchronized with the data voltage for sensing. The display lines L1-Ln are sequentially driven for sensing by the gate signals for sensing and the data voltage for sensing. Here, each display line L1 to Ln denotes an aggregate of R, W, G, and B pixels arranged adjacent to each other along the horizontal direction.

The gate driving unit 13 may generate gate signals for displaying based on the gate control signals GDC and sequentially supply them to the gate lines 15 in the display driving. The gate signals for displaying are scan signals for displaying synchronized with the data voltage for displaying. The display lines L1-Ln are sequentially driven for displaying by the gate signals for displaying and the data voltage for displaying.

A sense driving sequence which senses the pixel current varying depending on the operating point voltage of the light emitting element may be independently performed for each of R, W, G and B pixels. For example, the sense driving sequence of the present disclosure may sense R pixels in a line sequential manner for all display lines of the display panel 10, sense W pixels in the line sequential manner, sense G pixels in the line sequential manner, and then sense B pixels in the line sequential manner. This color sensing order may be set differently.

The power generator 30 generates a high potential pixel voltage EVDD and a low potential pixel voltage EVSS supplied to each pixel P. The power generator 30 generates the high potential pixel voltage EVDD in a DC form, and generates the low potential pixel voltage EVSS as an AC form. The power generator 30 generates the low potential pixel voltage EVSS at a first level lower than an amplifier reference voltage during a period of time the amplifier reference voltage is discharged through the light emitting element (that is, during TDIS in FIG. 5), thereby ensuring the stability of the discharging operation. The power generator 30 generates the low potential pixel voltage EVSS at a second level higher than a source voltage of the driving element set to correspond to an equivalent resistance of the light emitting element during the pixel current flowing through the driving element is being sensed (that is, during TSEN in FIG. 5), thereby ensuring the accuracy and reliability of the sensing operation. The second level of the low potential pixel voltage EVSS is higher than the first level of the low potential pixel voltage EVSS.

Figure 4:
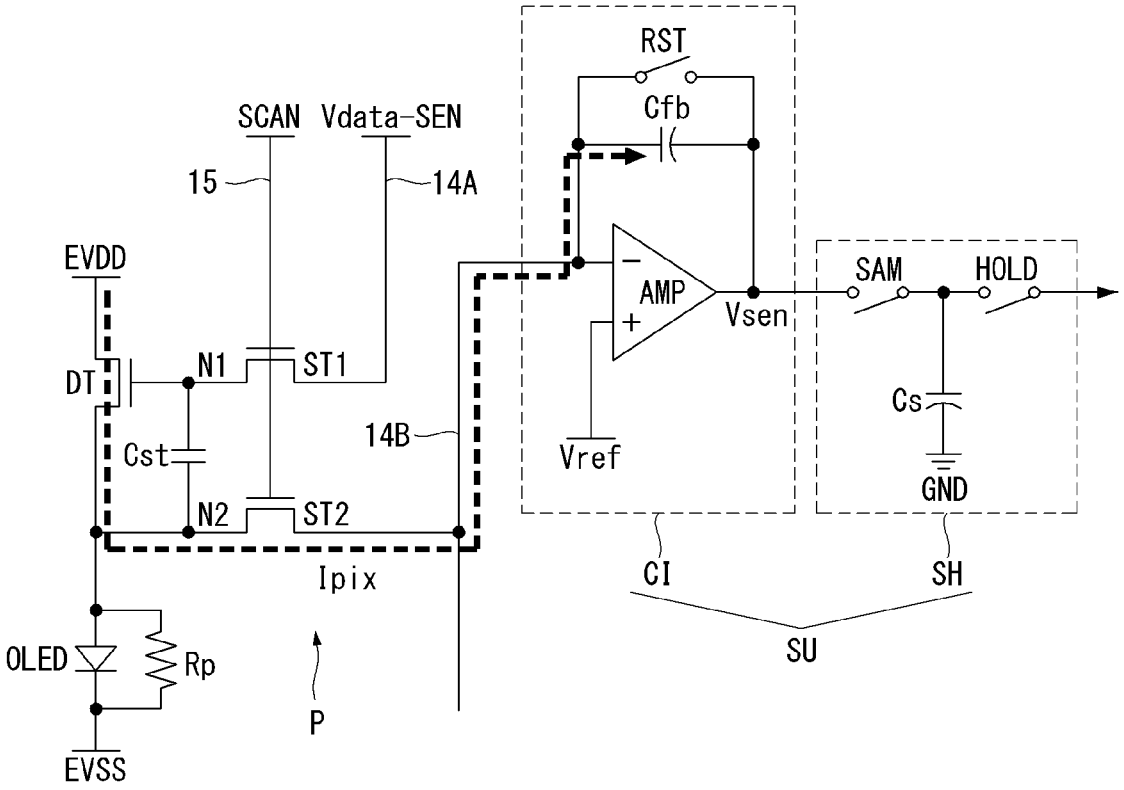
FIG. 4 shows a configuration of a pixel and a sensing unit.

FIG. 4 shows a configuration of a pixel and a sensing unit. It should be noted that the technical idea of the present disclosure is not limited to the example structure of the pixel P and the sensing unit SU, since FIG. 4 is merely an example.

Referring to FIG. 4, each pixel P may have an OLED, a driving TFT DT, a storage capacitor Cst, a first switch TFT ST1 and a second switch TFT ST2. The TFTs constituting the pixels P may be implemented as a p-type, n-type or a hybrid type in which the p-type and the n-type are mixed. A semiconductor layer of the TFTs constituting the pixels P may include amorphous silicon, polysilicon, or an oxide.

The OLED is a light emitting element emitting light according to a pixel current. The OLED includes an anode electrode connected to a second node N2, a cathode electrode connected to an input terminal of the low potential pixel voltage EVSS, and an organic compound layer positioned between the anode and cathode electrodes. The organic compound layer comprises a hole injection layer HIL, a hole transport layer HTL, an emission layer EML, an electron transport layer ETL and an electron injection layer EIL. If a driving voltage is applied to the anode and cathode electrodes, holes passing through the hole transport layer HTL and electrons passing through the electron transport layer ETL move to the emission layer EML to form excitons, and as a result the emission layer emits visible light.

The equivalent resistance Rp and the operating point voltage of the OLED may vary depending on the process variation and deterioration deviation of the OLED. The organic compound layer serves as a resistance between the anode and cathode electrodes. If thicknesses of the organic compound layer in a first pixel and a second pixel are different owing to the process variation of the OLED, moving distances of the electrons and holes in the first pixel and the second pixel are different, so the equivalent resistance Rp of the OLED may differ in the first pixel and the second pixel. Also, if moving degrees of the electrons and holes in the organic compound layer vary due to the deterioration of the OLED, the equivalent resistance Rp of the OLED may differ in the first pixel and the second pixel. The operating point voltage capable of turning on the OLED is determined by the equivalent resistance Rp of the OLED.

As the thickness of the organic compound layer constituting the OLED becomes larger or the deterioration becomes worse, the equivalent resistance Rp and the operating point voltage become larger, and as the thickness of the organic compound layer becomes smaller or the deterioration becomes less, the equivalent resistance Rp and the operating point voltage become smaller. Since the operating point voltage of the OLED is proportional to the equivalent resistance Rp of the OLED, if the equivalent resistance Rp varies, then the operating point voltage of the OLED also varies. Since the operating point voltage of the OLED is the source voltage of the driving element, a difference of the operating point voltage of the OLED appears as a difference of the pixel current. So, when the pixel current is sensed, the difference in driving characteristics (the operating point voltage of the OLED) of the OLED due to the process variation or deterioration deviation may be identified.

The driving TFT DT is a driving element for generating a pixel current corresponding to a gate-source voltage, that is a voltage difference between a gate voltage and a source voltage. The driving TFT DT has a gate electrode connected to a first node N1, a drain electrode connected to an input terminal of a high potential pixel voltage EVDD, and a source electrode connected to a second node N2. The driving TFT DT generates a more pixel current as the gate-source voltage becomes larger, and driving TFT DT generates a less pixel current as the gate-source voltage becomes smaller.

The storage capacitor Cst is connected between the first node N1 and the second node N2 to maintain the gate-source voltage of the driving TFT DT. The first switch TFT ST1 applies a data voltage Vdata-SEN for sensing charged in the data line 14A to the first node N1 responding to the gate signal SCAN for sensing. The data voltage Vdata-SEN for sensing includes a data voltage for on-driving and a data voltage for off-driving. The first switch TFT is equipped with a gate electrode connected to the gate line 15, a drain electrode connected to the data line 14A and a source electrode connected to the first node N1. The second switch TFT ST2 turns on/off the current flow between the second node N2 and the sensing line 14B. The second switch TFT ST2 is equipped with a gate electrode connected to the gate line 15, a drain electrode connected to the sensing line 14B, and a source electrode connected to the second node N2.

The sensing unit SU is connected to the pixel P through the sensing line 14B. The sensing unit SU may include a current integrator CI and a sample&hold unit SH.

The current integrator CI generates a sensing output voltage Vsen by integrating the pixel current input from the pixel P. The pixel current Ipix is determined according to the gate-source voltage depending on the source voltage of the driving TFT DT, and inversely proportional to the operating point voltage of the OLED. The current integrator CI outputting the sensing output voltage Vsen through an output terminal includes an amplifier AMP, an integral capacitance Cfb connected between an inverting input terminal (−) and an output terminal of the amplifier AMP, and a reset switch RST connected to both terminals of the integral capacitance Cfb. The non-inverting input terminal (+) of the amplifier AMP applies an amplifier reference voltage Vref to the second node N2 through the sensing line 14B, and receives the pixel current Ipix flowing through the driving TFT DT through the sensing line 14B. The amplifier reference voltage Vref is input to the inverting input terminal (−) of the amplifier AMP.

The current integrator CI is connected to an ADC through a sample&hold unit SH. The sample&hold unit SH includes a sampling switch SAM for sampling the sensing output voltage Vsen output from the amplifier AMP and storing the sensing output voltage Vsen in a sampling capacitor Cs. The sample&hold unit SH further includes a holding switch HOLD for transmitting the sensing output voltage Vsen stored in the sampling capacitor Cs to the ADC.

Figure 5:
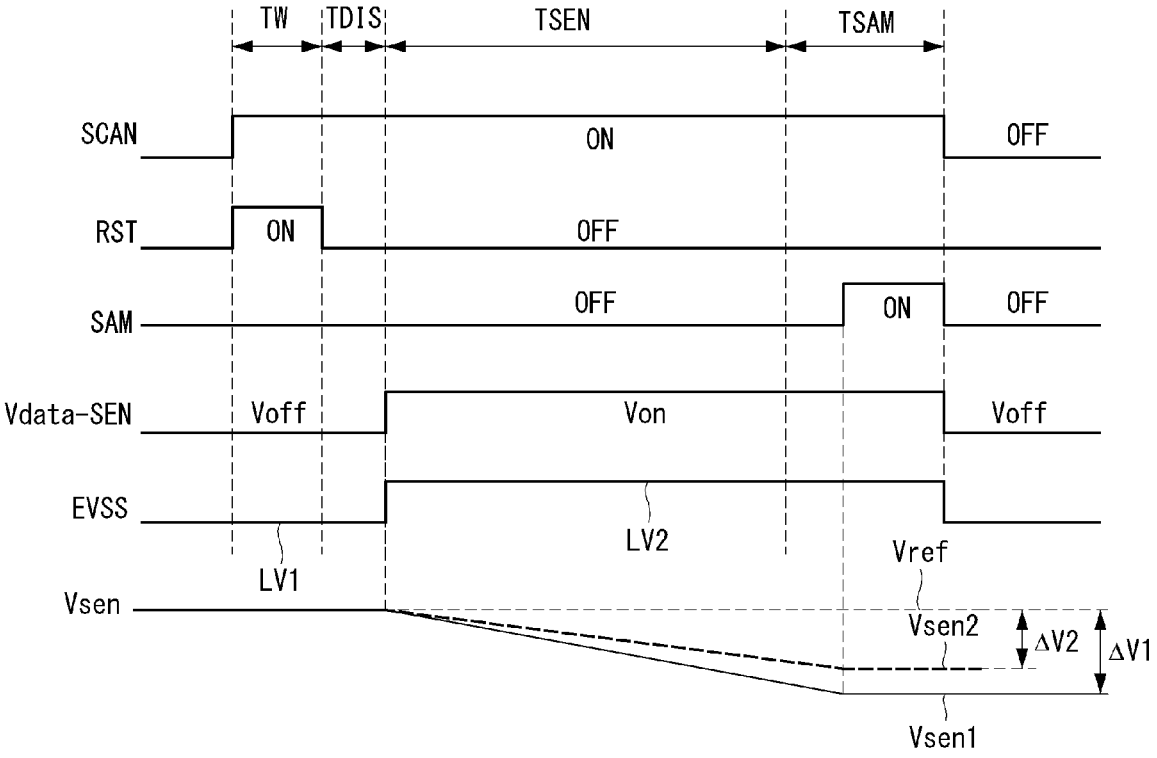
FIG. 5 shows waveforms of driving signals for the pixel and the sensing unit.
Figure 6:
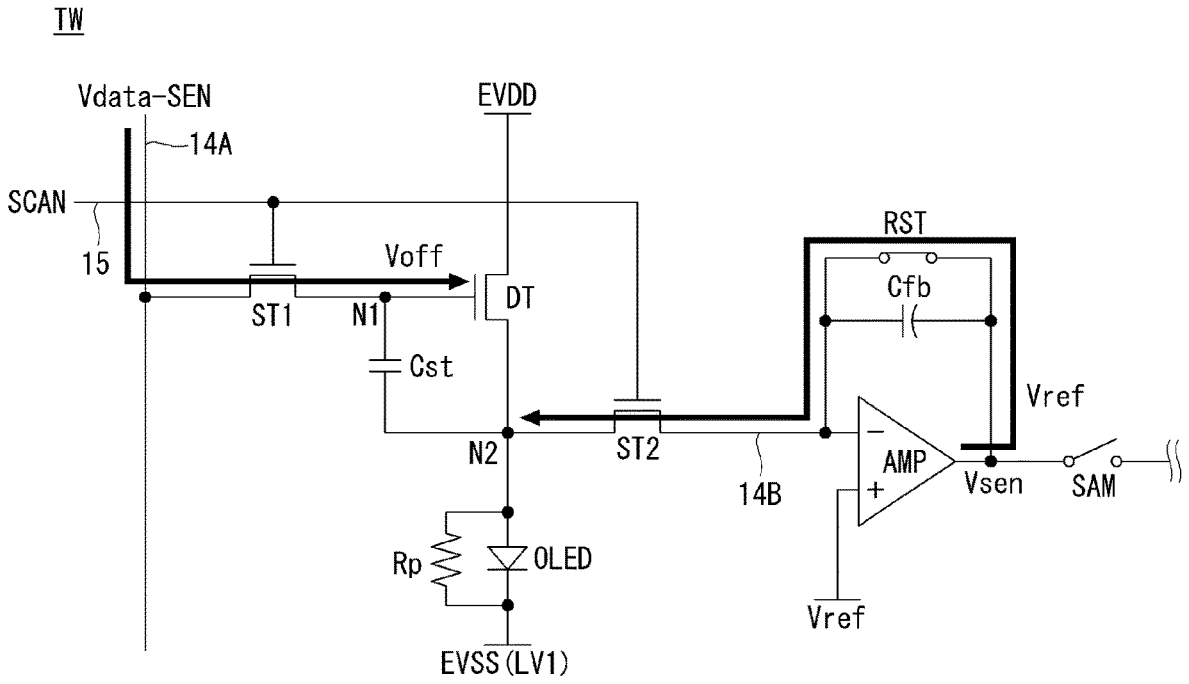
FIG. 6 shows an equivalent circuit of the pixel and sensing unit in a programing period of FIG. 5.
Figure 7:
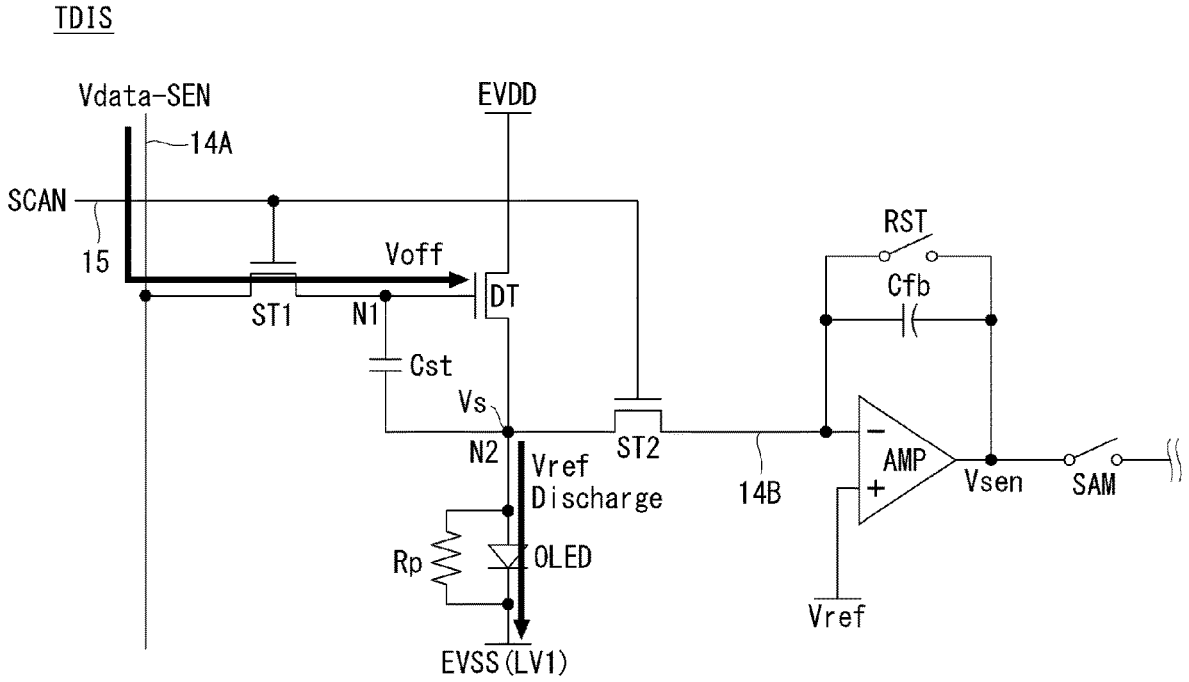
FIG. 7 shows an equivalent circuit of the pixel and sensing unit in a discharging period of FIG. 5.
Figure 8:
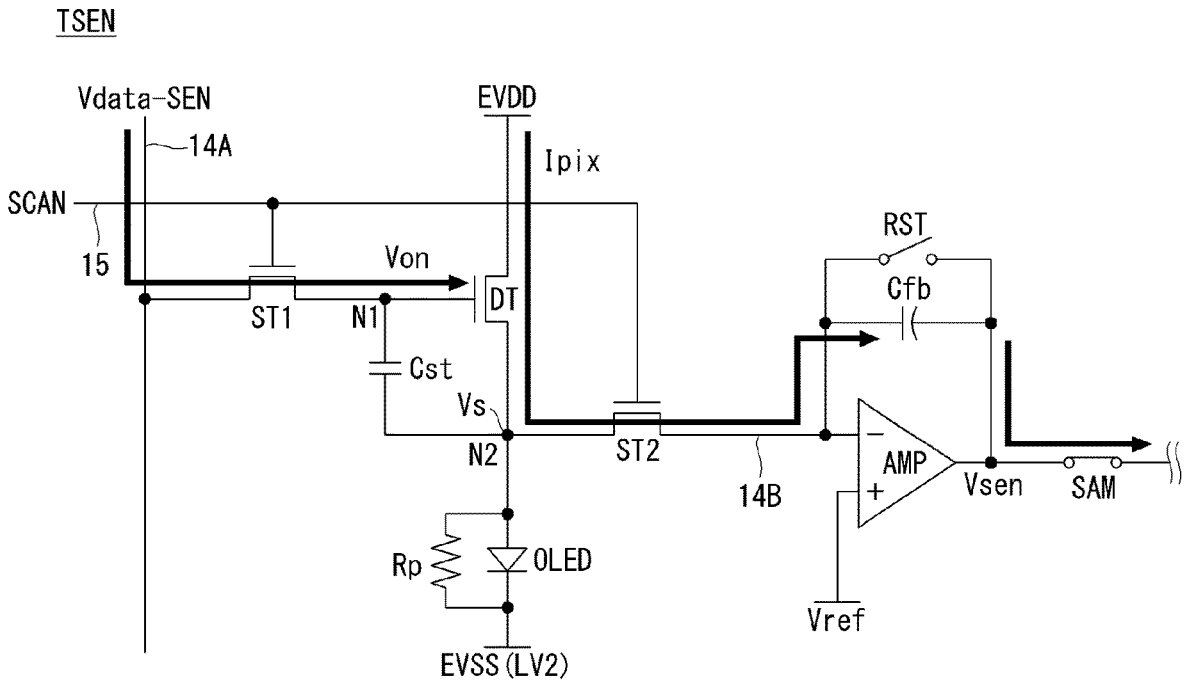
FIG. 8 shows an equivalent circuit of the pixel and sensing unit in a sensing period of FIG. 5.
Figure 9:
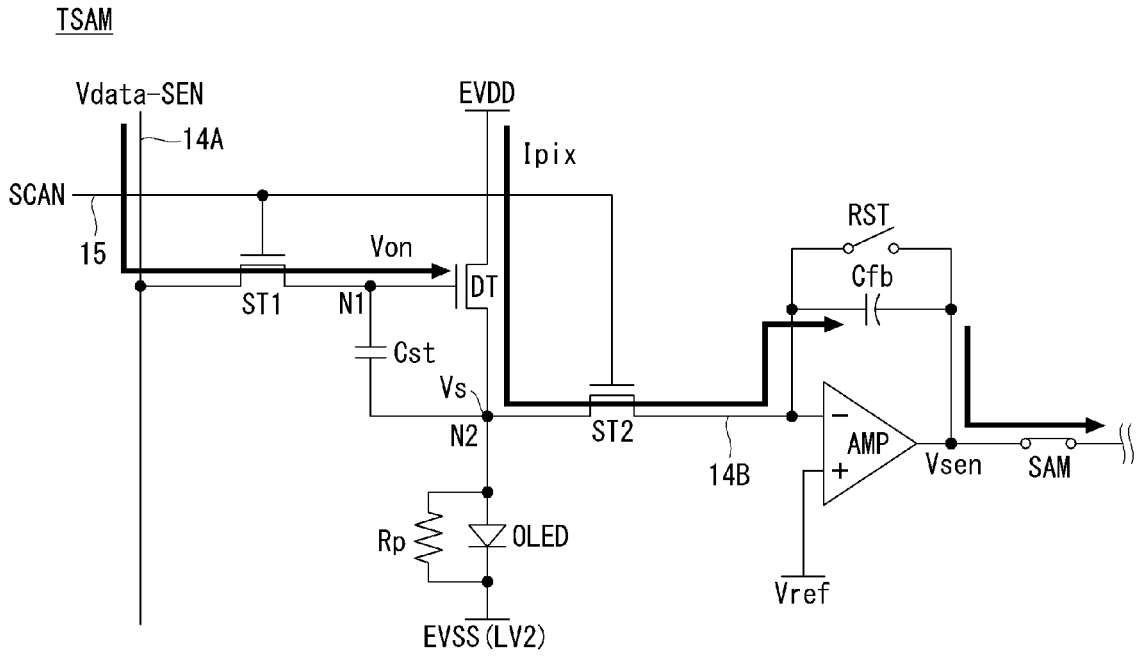
FIG. 9 shows an equivalent circuit of the pixel and sensing unit in a sampling period of FIG. 5.

FIG. 5 shows waveforms of driving signals for the pixel and the sensing unit, FIG. 6 shows an equivalent circuit of the pixel and sensing unit in a programing period of FIG. 5, FIG. 7 shows an equivalent circuit of the pixel and sensing unit in a discharging period of FIG. 5, FIG. 8 shows an equivalent circuit of the pixel and sensing unit in a sensing period of FIG. 5, and FIG. 9 shows an equivalent circuit of the pixel and sensing unit in a sampling period of FIG. 5.

Referring to FIG. 5, a sense driving sequence of the present disclosure may proceed in the order of a programming period TW, a discharging period TDIS, a sensing period TSEN, and a sampling period TSAM.

Referring to FIGS. 5 and 6, in the programming period TW, the current integrator CI operates as a unit gain buffer with a gain of one due to the turn-on of the reset switch RST, so the input terminals (−) and (+) and the output terminal of the amplifier AMP and the sensing line 14B are initialized to the amplifier reference voltage Vref. The amplifier reference voltage Vref is set to be higher than the operating point voltage of the OLED.

In the programming period TW, the data voltage Vdata-SEN for sensing, that is the data voltage Voff for off-driving is charged in the data line 14A. And, the gate signal SCAN for sensing is applied at an on level in synchronization with the data voltage Voff for off-driving, which turns on the first and second switch TFTs ST1 and ST2. In the programming period TW, the first switch TFT ST1 is turned on to apply the data voltage Voff for off-driving charged in the data line 14A to the first node N1, and the second switch TFT ST2 is turned on to apply the amplifier reference voltage Vref charged in the sensing line 14B to the second node N2. In the programming period TW, the low potential pixel voltage EVSS is applied to a cathode electrode of the OLED at a first level LV1 lower than the amplifier reference voltage Vref.

So, the driving TFT DT is turned off, and the OLED is turned on by the amplifier reference voltage Vref higher than the operating point voltage. An emitting current corresponding to an equivalent resistance flows to the OLED.

Referring to FIGS. 5 and 7, in the discharging period TDIS, the reset switch RST is turned off. In the discharging period TDIS, the second node N2 is not supplied with the amplifier reference voltage Vref due to the turn-off of the reset switch RST, and the amplifier reference voltage Vref charged in the second node N2 is discharged through the OLED. So, in the discharging period TDIS, a source voltage Vs of the driving TFT DT, that is a voltage of the second node N2 which is discharged (e.g., from the amplifier voltage Vref) and left (e.g., remains on the second node N2) becomes the operating point voltage of the OLED which is proportional to the equivalent resistance Rp of the OLED. The equivalent resistance Rp and the operating point voltage of the OLED become larger as a thickness or deterioration of the organic compound layer constituting the OLED increases. To the contrary, the smaller the thickness or deterioration of the organic compound layer, the smaller the equivalent resistance Rp and the operating point voltage of the OLED.

Meanwhile, in the discharging period TDIS, the low potential pixel voltage EVSS is applied to the cathode electrode of the OLED at the first level LV1 lower than the amplifier reference voltage Vref. So, a discharging operation through the OLED may proceed smoothly. In conclusion, in the discharging period TDIS, the amplifier reference voltage Vref is discharged through the OLED to be set such that the source voltage Vs of the driving TFT DT corresponds to the equivalent resistance Rp of the OLED.

Referring to FIGS. 5 and 8, in the sensing period TSEN, the first and second switch TFTs ST1 and ST2 maintain their turn-on state responding to the gate signal SCAN for sensing of a on level. At this time, the data voltage Vdata-SEN for sensing, that is a data voltage Von for on-driving is charged in the data line 14A. The data voltage Von for on-driving is applied to the first node N1 through the first switch TFT ST1 to be a gate voltage of the driving TFT DT, and the source voltage Vs of the driving TFT DT which is set in the discharging period TDIS is maintained in the second node N2. So, in the sensing period TSEN, the gate-source voltage of the driving TFT DT becomes higher than a threshold voltage of the driving TFT DT, and the driving TFT DT is turned on to generate the pixel current Ipix.

The gate-source voltage of the driving TFT DT determines a magnitude of the pixel current Ipix. The source voltage Vs of the driving TFT DT which is the operating point voltage of the OLED may vary depending on the equivalent resistance Rp of the OLED while the gate voltage of the driving TFT DT is fixed as the data voltage Von for on-driving. The higher the operating point voltage of the OLED, that is the source voltage Vs of the driving TFT DT is, the smaller the gate-source voltage and the pixel current Ipix of the driving TFT DT is. To the contrary, the lower the operating point voltage of the OLED, that is the source voltage Vs of the driving TFT DT is, the larger the gate-source voltage and the pixel current Ipix of the driving TFT DT is. So, by sensing the pixel current, a relative magnitude of the operating point voltage of the OLED may be known.

In the sensing period TSEN, the current integrator CI senses the pixel current Ipix input through the sensing line 14B. The pixel current Ipix is accumulated in the integral capacitor Cfb of the current integrator CI to change the sensing output voltage Vsen. The sensing output voltage Vsen loaded to the output terminal of the current integrator CI maintains the amplifier reference voltage Vref in the programming and discharging periods TW and TDIS, and then decreases from the amplifier reference voltage Vref as the pixel current is accumulated in the sensing period TSEN. A decreasing slope of the sensing output voltage Vsen is proportional to a magnitude of the pixel current Ipix.

For instance, in FIG. 5, a first pixel current corresponding to a first sensing output voltage Vsen1 is larger than a second pixel current corresponding to a second sensing output voltage Vsen2. The operating point voltage of the OLED may be determined based on a difference ΔV1 of the sensing output voltage Vsen1 and the amplifier reference voltage Vref, and the operating point voltage of the OLED may be determined based on a difference ΔV2 of the sensing output voltage Vsen2 and the amplifier reference voltage Vref Meanwhile, in the sensing period TSEN, the low potential pixel voltage EVSS is applied to the cathode electrode of the OLED at a second level LV2 higher than the operating point voltage Vs of the OLED. Since the pixel current Ipix generated in the driving TFT DT does not flow into the OLED and is all applied to the current integrator CI via the second switch TFT2 and the sensing line 14B, accuracy of sensing may be increased.

Finally, in the sensing period TSEN, the pixel current Ipix flowing through the driving TFT DT according to the gate-source voltage determined by the source voltage Vs of the driving TFT DT is sensed.

Referring to FIGS. 5 and 9, in the sampling period TSAM, the sampling switch SAM is turned on, and the sensing output voltage loaded to the output terminal of the current integrator CI is sampled and stored in the sampling capacitor Cs. The low potential pixel voltage EVSS is applied to the cathode electrode of the OLED at the second level LV2 higher than the operating point voltage Vs in the sampling period TSAM.

Figure 10:
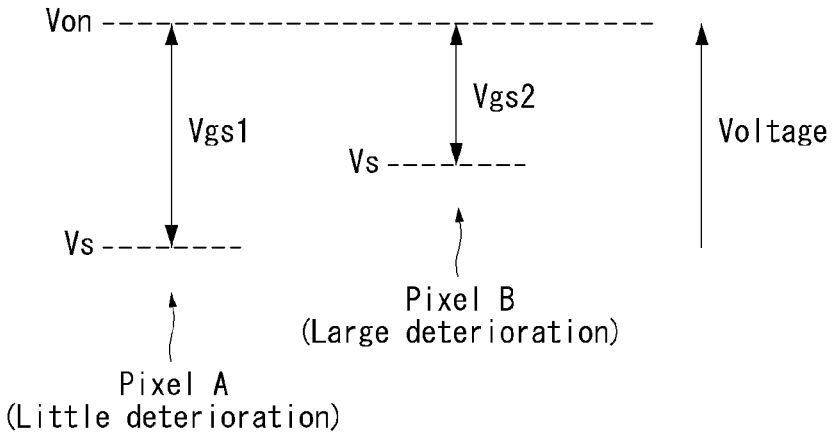
FIG. 10 shows that an equivalent resistance of an OLED, a gate-source voltage of a driving TFT, a pixel current, and a sensing output voltage vary depending on a degree of deterioration of the OLED.

FIG. 10 shows that an equivalent resistance of an OLED, a gate-source voltage of a driving TFT, a pixel current, and a sensing output voltage vary depending on a degree of deterioration of the OLED.

Referring to FIG. 10, the gate-source voltage of the driving TFT DT determines the magnitude of the pixel current Ipix. The gate voltage of the driving TFT DT is fixed to the data voltage Von for on-driving, and the source voltage Vs of the driving TFT DT, and the source voltage Vs of the driving TFT DT which is the operating point voltage of the OLED may vary depending on the equivalent resistance Rp of the OLED Since the pixel A with little deterioration has a relatively low source voltage Vs of the driving TFT DT (that is, the operating point voltage of the OLED), the gate-source voltage Vgs1 of the driving TFT DT is relatively large. Since the pixel B with large deterioration has a relatively high source voltage Vs of the driving TFT DT (that is, the operating point voltage of the OLED), the gate-source voltage Vgs1 of the driving TFT DT is relatively small. So, a first pixel current Ipix1 flowing in the pixel A is larger than a second pixel current Ipix2 flowing in the pixel B. As a result, a second sensing output voltage Vsen2 for the second pixel current Ipix2 is higher than a first sensing output voltage Vsen1 for the first pixel current Ipix1. So, by sensing the pixel current, a relative magnitude of the operating point voltage of the OLED may be known. The sensing method of the present disclosure based on the difference of the equivalent resistances Rp of the OLEDs has an advantage that the driving characteristics of the OLEDs may be accurately sensed. Continuing with the example above, the second sensing output voltage Vsen2 being higher than the first sensing output voltage Vsen1 indicates that pixel B has larger deterioration than pixel A (e.g., pixel B has a higher operating point voltage than pixel A). To correct for a given input image data, a corrected data voltage for pixel B would be a higher corrected data voltage than the corrected data voltage for pixel A. In another example, an OLED may have a first sensing output voltage Vsen1 and second sensing output voltage Vsen2 obtained at different times as the OLED is operated. The second sensing output voltage Vsen2 being higher than the first sensing output voltage Vsen1 indicates the pixel has deteriorated with operation. The compensation unit 20 may correct a given input image data, the corrected image data may include a higher data voltage corresponding to the second sensing output voltage Vsen2 than for Vsen1. In other words, responsive to an increase in sensing output voltage for the OLED, a data voltage corresponding to the corrected image data is increased.

As described above, the present disclosure focuses on the fact that the equivalent resistance of the OLED varies depending on the process variation or the deterioration deviation, so that the OLED equivalent resistance is reflected on the gate-source voltage and the pixel current of the driving element. And, a magnitude of the sensing output voltage determines the driving characteristics of the OLED, that is, the relative magnitude of the operating point voltage.

The present disclosure is advantageous in that the driving characteristics of the OLED may be sensed more accurately than a conventional sensing method based on parasitic capacitance differences of OLEDs.

Throughout the description, it should be understood by those skilled in the art that various changes and modifications are possible without departing from the technical principles of the present disclosure. Therefore, the technical scope of the present disclosure is not limited to the detailed descriptions in this specification but should be defined by the scope of the appended claims.

What is claimed is:

1. A display device including a plurality of pixels, at least one of the pixels comprising:

an organic light emtting diode (OLED); and a driving transistor connected in series with the OLED with a node between the OLED and the driving transistor;

wherein during a programming period: a first voltage is applied to a cathode electrode of the OLED, the driving transistor is turned off, and the OLED is turned on, wherein during a discharging period: the first voltage is applied to the cathode electrode of the OLED, the driving transistor is turned off and a voltage charged on the node during the programming period is discharged through the OLED, and wherein during a sensing period: a second voltage is applied to the cathode electrode of the OLED, the OLED is turned off, and the driving transistor is turned on to generate a pixel current to be sensed, wherein the second voltage is higher than the first voltage.

2. The display device of claim 1, the at least one of the pixels further comprising a storage capacitor connected between the node and a gate of the driving transistor, wherein during the programming period: a reference voltage is applied to an end of the storage capacitor connected to the node, and a data voltage to turn off the driving transistor is supplied to an end of the storage capacitor connected to the gate of the driving transistor, wherein during the discharging period: a data voltage to turn off the driving transistor is supplied to the end of the storage capacitor connected to the gate of the driving transistor, and wherein the pixel current to be sensed is based on a remaining voltage left on the node after the voltage charged on the node during the programming period is discharged through the OLED.

3. The display device of claim 1, wherein during the programming period a reference voltage is applied to the node, the reference voltage being higher than an operating point voltage of the OLED.

4. The display device of claim 3, wherein the first voltage is lower than the reference voltage.

5. The display device of claim 1, wherein the second voltage is higher than an operating point voltage of the OLED.

6. The display device of claim 1, wherein during the programming period and the discharging period: a data voltage applied to a gate of the driving transistor is at a first level to turn off the driving transistor, and wherein during the sensing period: the data voltage applied to the gate of the driving transistor is at a second level to turn on the driving transistor.

7. The display device of claim 1, wherein during the programming period: a reset switch is turned on to allow a reference voltage to be supplied to the node, and wherein during the discharging period and the sensing period: the reset switch is turned off.

8. The display device of claim 1, further including a current integrator connected to the node, wherein during the sensing period the current integrator generates a sensing output voltage by integrating the pixel current, and wherein corrected image data is generated based on the sensing output voltage.

9. The display device of claim 8, wherein responsive to an increase in the sensing output voltage, a data voltage corresponding to the corrected image data is increased.

10. In a display device including a plurality of pixels, at least one of the pixels comprising an organic light emitting diode (OLED) and a driving transistor connected in series with the OLED with a node between the OLED and the driving transistor, a method comprising:

during a programming period: applying a first voltage to a cathode of the OLED, turning off the driving transistor and turning on the OLED;

during a discharging period: applying the first voltage to the cathode of the OLED, turning off the driving transistor, and discharging a voltage charged on the node during the programming period through the OLED, and during a sensing period: applying a second voltage to the cathode of the OLED, turning off the OLED, and turning on the driving transistor to generate a pixel current to be sensed, wherein the second voltage is higher than the first voltage.

11. The method of claim 10, further comprising:

during the programming period, applying a reference voltage to the node, the reference voltage being higher than an operating point voltage of the OLED.

12. The method of claim 11, wherein the first voltage is lower than the reference voltage.

13. The method of claim 10, wherein the second voltage is higher than an operating point voltage of the OLED.

14. The method of claim 10, further comprising:

during the programming period and the discharging period: applying a data voltage to a gate of the driving transistor at a first level to turn off the driving transistor, and during the sensing period: applying the data voltage to the gate of the driving transistor at a second level to turn on the driving transistor.

15. The method of claim 10, further comprising:

during the programming period: turning on a reset switch to allow a reference voltage to be supplied to the node, and during the discharging period and the sensing period: turning off the reset switch.

16. The method of claim 10, further comprising:

during the sensing period: generating a sensing output voltage by a current integrator connected to the node by integrating the pixel current, and generating corrected image data based on the sensing output voltage.

17. The method of claim 16, wherein responsive to an increase in the sensing output voltage, a data voltage corresponding to the corrected image data is increased.

18. A display panel including a plurality of pixels, at least one of the pixels comprising:

a light emitting device; and a driving transistor connected in series with the light emitting device with a gate of the driving transistor connected to a first node and with a second node between the light emitting device and the driving transistor, wherein during a programming period: a first voltage is applied to a cathode electrode of the OLED, the driving transistor is turned off, and the light emitting device is turned on, wherein during a discharging period: the first voltage is applied to the cathode electrode of the OLED, the driving transistor is turned off and a voltage charged on the second node during the programming period is discharged through the light emitting device, and wherein during a sensing period: a second voltage is applied to the cathode electrode of the OLED, the light emitting device is turned off, and the driving transistor is turned on to generate a pixel current to be sensed, wherein the second voltage is higher than the first voltage.

19. The display panel of claim 18, wherein during the programming period a reference voltage is applied to the second node, the reference voltage being higher than an operating point voltage of the light emitting device.

20. The display panel of claim 19, wherein the first voltage is lower than the reference voltage, and wherein the second voltage is higher than an operating point voltage of the light emitting device.

* * * * *